US010285900B2

(12) United States Patent
Elliott

(10) Patent No.: US 10,285,900 B2
(45) Date of Patent: May 14, 2019

(54) FELLATIO APPARATUS AND METHOD

(71) Applicant: Gayle Elliott, Lowell, IN (US)

(72) Inventor: Gayle Elliott, Lowell, IN (US)

( * ) Notice: Subject to any disclaimer, the term of this patent is extended or adjusted under 35 U.S.C. 154(b) by 56 days.

(21) Appl. No.: 15/392,737

(22) Filed: Dec. 28, 2016

(65) Prior Publication Data

US 2018/0177676 A1 Jun. 28, 2018

(51) Int. Cl.
*A61H 19/00* (2006.01)
*B05B 9/08* (2006.01)

(52) U.S. Cl.
CPC ..... *A61H 19/50* (2013.01); *A61H 2201/105* (2013.01); *A61H 2201/165* (2013.01); *B05B 9/0838* (2013.01)

(58) Field of Classification Search
CPC ..... A61F 2/26; A61F 5/453; A61F 2/0054; A61F 13/471; A61F 5/48; A61F 6/04; A61F 5/44; A61F 5/4408; A61F 5/41; A61H 19/32; A61H 19/50
See application file for complete search history.

(56) References Cited

U.S. PATENT DOCUMENTS 4,982,731 A * 1/1991 Lue ..... A61F 2/26 600/40

* cited by examiner

*Primary Examiner* — Christine H Matthews
(74) *Attorney, Agent, or Firm* — Law Office of Jeff Williams PLLC; J. Oliver Williams

(57) ABSTRACT

A device and method for the enhancement of performing fellatio is described. The device includes a bulbous member, a hose member, and a plurality of band members. The band members surround the shaft of the penis and are configured to route or locate the hose member. The hose member is positioned toward the glans of the penis. The bulbous member is filled with a liquid that is selectively dispensed by either participating party during fellatio. The liquid is routed to the glans for dispersion into the performer's mouth to be mixed with ejaculate. The liquid alters the taste of the ejaculate to enhance the fellatio experience for the performer.

18 Claims, 3 Drawing Sheets

FELLATIO APPARATUS AND METHOD

BACKGROUND

1. Field of the Invention

The present application relates to an adult toy, and more particularly to a device used during the performing of fellatio.

2. Description of Related Art

The act of performing fellatio is not new. Stimulation of a man's penis to result in ejaculation can be done in any number of ways. For example, there is self-stimulation or stimulation via another partner. Fellatio is defined as the giving of oral stimulation to a man's penis. A problem with fellatio is deciding what to do with the ejaculate from the male. Two main options are spitting it from the mount or swallowing it. Spitting it out can result in a mess to clean up. Swallowing is less messy and can be more appealing to the male or female. A big factor in determining whether the semen will be swallowed is the overall flavor or taste of the semen. The taste of a man's semen is not typically pleasing to individuals. Steps may be taken to alter or influence the overall taste. For example, drinking certain drinks can alter or change the taste to a degree. However, this only has some effect and fails in masking the true taste to a large degree.

Although strides have been made to increase sexual relations between couples through the performance of fellatio, shortcomings remain. A device is needed to provide a method of diluting or more fully masking the taste of semen to encourage swallowing with fellatio.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
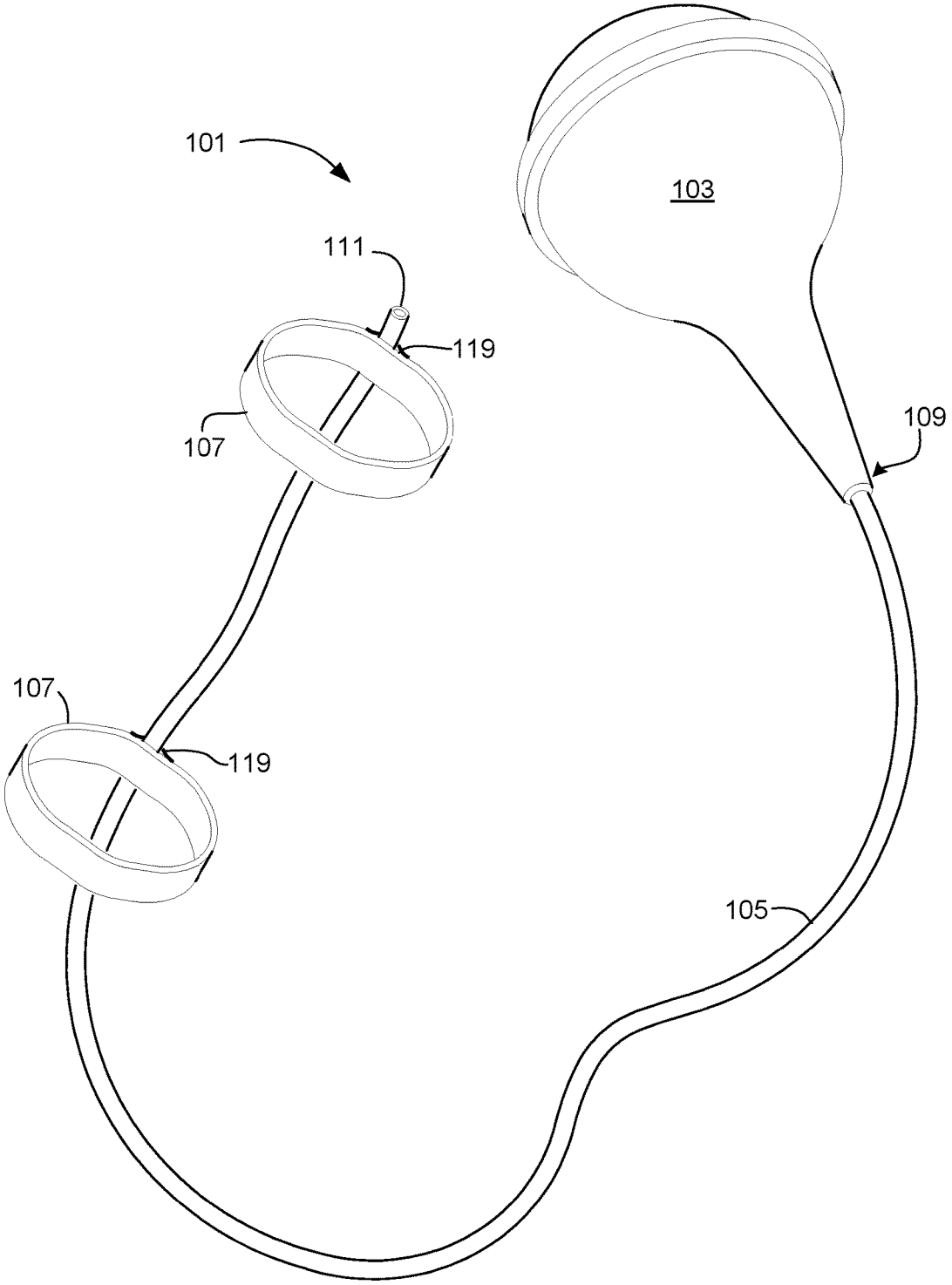
FIG. 1 is a perspective view of a fellatio device according to an embodiment of the present application.

While the device and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The device and method in accordance with the present application overcomes one or more of the above-discussed problems commonly associated with traditional methods of performing fellatio. In particular, the device is configured to provide the ability to selectively introduce a liquid into the mouth of the performer to assist with swallowing ejaculate. The device is configured to create minimal interference with the performer during the act. Either the receiver or the performer may control the amount and timing of the liquid. These and other unique features of the device are discussed below and illustrated in the accompanying drawings.

The device and method will be understood, both as to its structure and operation, from the accompanying drawings, taken in conjunction with the accompanying description. Several embodiments of the device may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The device and method of the present application is illustrated in the associated drawings. The device includes a plurality of bands used to support a hose member. The hose member has a first end adjacent one of the plurality of bands and a second end in communication with a bulb member. Compression of the bulb member passes liquid through the hose member and out the first end. Additional features and functions of the device are illustrated and discussed below.

Figure 2:
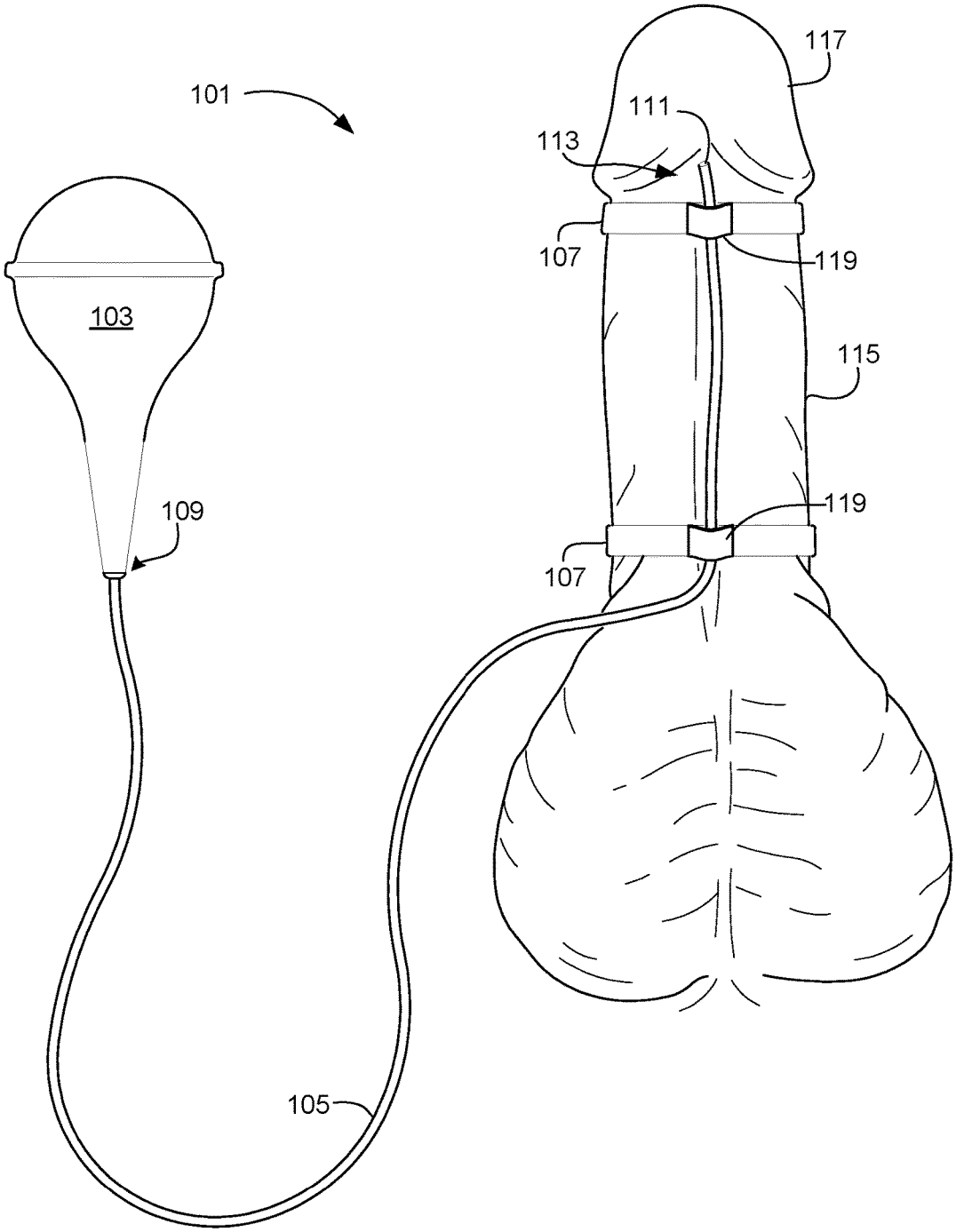
FIG. 2 is a bottom view of the fellatio device of FIG. 1 located on a male penis.
Figure 3:
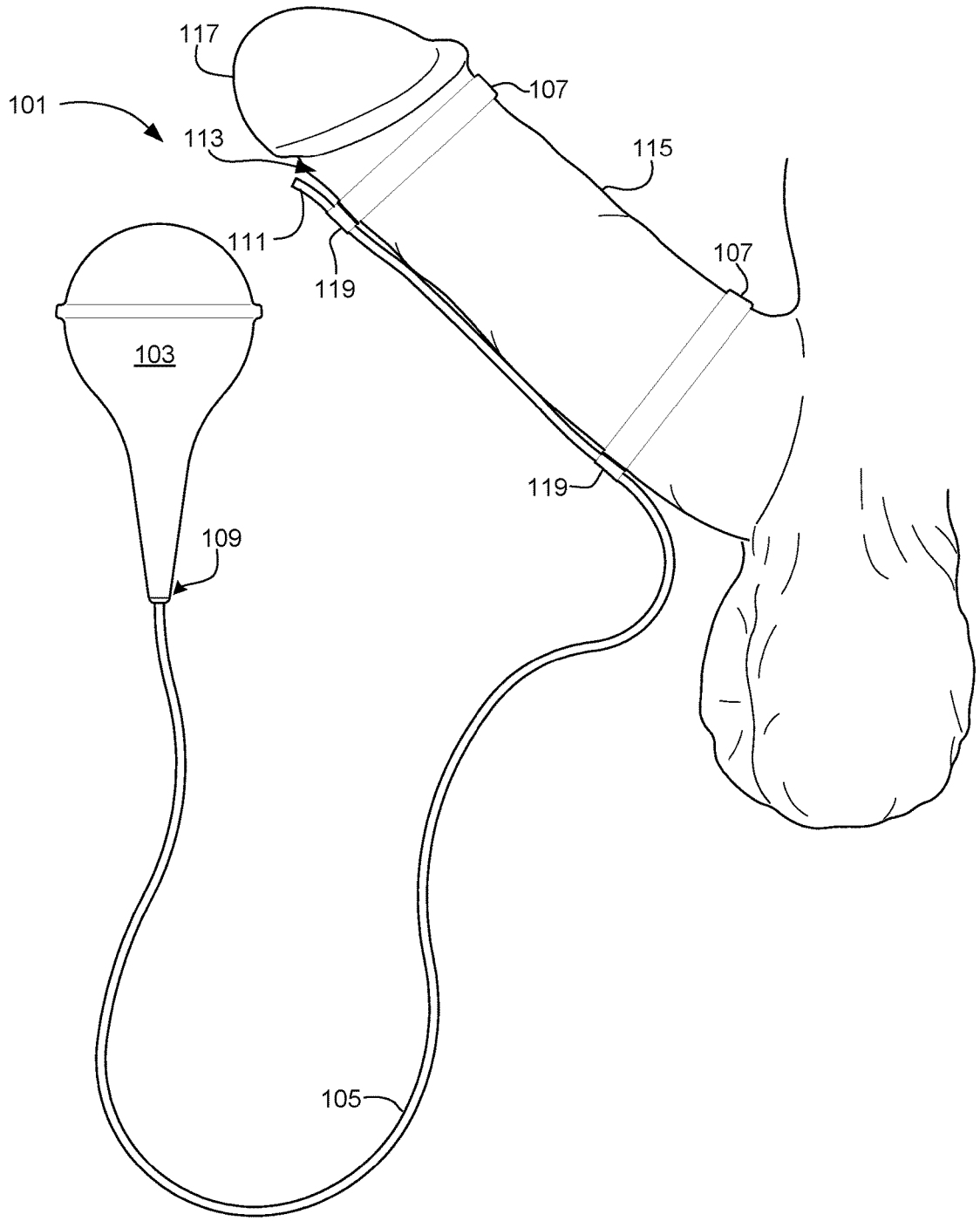
FIG. 3 is a side view of the fellatio device of FIG. 1 located on a male penis.

Referring now to the drawings wherein like reference characters identify corresponding or similar elements in form and function throughout the several views. FIGS. 1-3 illustrate assorted views of fellatio device 101 of the present application. FIG. 1 in particular illustrates a perspective view of device 101. Device 101 includes a bulbous member 103, a hose member 105, and a plurality of bands 107. Member 103 is configured to retain a portion of liquid. The liquid is selectively passed through the hose member 103 and into the mount of the performer. The liquid is to mix with the ejaculate from the penis and alter the natural taste of the semen to a more desirable flavor.

As seen in the Figures, device 101 is configured to provide an individual the ability to selectively dispense a liquid through hose 105. For purposes herein, the act of fellatio requires a male "receiver" and a "performer" who performs the act of fellatio on the receiver. The performer may be of either gender. Device 101 is configured to allow either the receiver or the performer the ability to selectively control the amount and timing related to the release of liquid from member 103.

Bulbous member 103 is a flexible item that has at least one opening 109 leading to an interior volume (i.e. similar in form and function to a bulbous aspirator). Liquid is stored within the interior volume and selectively dispensed as desired. Member 103 is in selective communication with hose 105. Hose 105 may be pulled out from opening 109 to allow for the filling of member 103. The filling of member 103 may be performed with hose 105 attached but the overall process is hindered by the length of hose 105. When detached, member 103 may be filled by compressing its body to remove the air within the interior volume as opening 109 is submerged. As member 103 is uncompressed, liquid is pulled (i.e. vacuum) within the interior volume. The liquid may be stored there indefinitely.

Hose member 105 is a flexible tubular hose configured to selectively couple to the opening 109 of member 103. Hose 105 is designed to route the liquid leaving member 103. Hose member includes a first end and a second end opposite that of the first end. The second end is the portion in communication with opening 109. First end 111 is the port where the liquid is dispensed from hose 105. First end 111 is located adjacent to band members 107. An example of hose 105 may be similar in form and function to that of a surgical tube.

Band members 107 are configured to locate hose 105 such that first end 111 is near the frenulum 113 of the penis along the lower side of the penis shaft 115. Band members 107 are located along shaft 115, namely one being at the base of shaft 115 and the other toward the glans 117 of the penis. As seen in the figures, hose 105 is routed through both band members 107. It is understood that hose 105 may be routed through one or more band members 107. Use of both band members allows hose 105 to remain aligned with shaft 115 so as to avoid hindering the performance of the fellatio.

Band members 107 are soft flexible non-latex bands that are configured to stretch and conform to the circumference of shaft 115. The band members 107 may include a channel 119 for acceptance of hose 105. It is a goal of band members 107 to generate as minimal obstruction or interference as possible. Their size and shape may be selected to accomplish this objective. Band members 107 can come in different forms thereby permitting different functions. For example, band members 107 may be a singular member that stretches over and around the penis. Another example may include where band members 107 may selectively separate along a portion to allow them to wrap around the penis. This would permit the user the ability to adjust the tension of the band members by tightening or loosening them. Band members 107 may come in different sizes. Additionally, band members of different sizes may be used together.

In use, a user (either the receiver or performer) elects to fill bulbous member 103 with the liquid. The liquid may be a juice, carbonated soft-drink, milk, or any other liquid. The filling may be done with hose 105 detached from opening 109, or done through hose 105. Hose 105 is routed through at least one of band members 103. Band members 107 are located along shaft 115. The position of each band member may be selectively adjusted to suit the preferences of the receiver and the performer. For example, band members 107 may be situated along shaft 115 at any location. Additionally, band members 107 may be rotated to adjust the routing of hose 105.

As fellatio is being performed, the liquid typically remains in bulbous member 103. At the time of ejaculation, either party may compress bulbous member 103 to dispense the liquid out opening 109 and subsequently out first end 111 into the mouth of the performer. The liquid mixes with the ejaculate and alters the taste of the ejaculate to make it more pleasing to swallow.

The tension of band members 107 may be adjusted by loosening or tightening each band member, or by replacing a band member for another. For subsequent uses, the portions may be decoupled from one another for simplified cleaning. The steps of use may be repeated for another pleasurable experience.

The current application has many advantages over the prior art including at least the following: (1) a simplified method of altering the taste of ejaculate; (2) streamlined contour to minimize obstruction to the fellatio experience; (3) versatile control of the liquid; and (4) ability to adjust the location, orientation, and tension of the band members.

The particular embodiments disclosed above are illustrative only and are not intended to be exhaustive or to limit the invention to the precise form disclosed, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A fellatio device, comprising:

a bulbous member configured to retain a liquid;

a hose member in communication with the bulbous member, the hose member includes an opening distal to the bulbous member for a discharge of the liquid external to the bulbous member and external to the hose member; and a plurality of band members configured to locate the hose member, the distal opening being external to the band members and the bulbous member; and a channel formed on an outer surface of each of the plurality of band members, each channel forming a loop external to the plurality of band members, the hose member configured to pass through the channels, the channels and the plurality of band members being located between the bulbous member and the distal opening of the hose member;

wherein liquid is selectively passed from the bulbous member and through the hose such that the liquid is passed beyond the band members and out through the distal opening.

2. The device of claim 1, wherein the bulbous member is flexible.

3. The device of claim 1, wherein the liquid escapes the bulbous member as the bulbous member is compressed.

4. The device of claim 1, wherein the liquid is retained within the bulbous member via vacuum pressure.

5. The device of claim 1, wherein the channels are configured to each form a loop for locating and securing the hose member relative to a penis.

6. The device of claim 1, wherein the hose member passes through at least one of the plurality of band members.

7. The device of claim 1, wherein a location of the hose member can be changed relative to a penis.

8. The device of claim 1, wherein tension within at least one of the plurality of band members may be adjusted.

9. A method of performing fellatio, comprising:

obtaining the fellatio device of claim 1;

filling the bulbous member with a liquid;

connecting the hose member to the bulbous member, the hose member having a second end in communication with the bulbous member and a first end distal to the bulbous member, the first end including the distal opening;

routing the hose member through the channel of at least one of the plurality of band members, the first end of the hose member adjacent at least one of the plurality of band members, the distal opening located at the first end;

positioning the hose member in a linear manner relative to a penis; and dispensing the liquid through the first end such that the liquid exits the hose member outside of the bulbous member and the plurality of band members for mixture with ejaculate.

10. The method of claim 9, wherein the bulbous member is flexible.

11. The method of claim 9, wherein dispensing of the liquid is done by compressing the bulbous member.

12. The method of claim 9, wherein the plurality of band members wrap around a portion of the penis.

13. The method of claim 9, further comprising:

adjusting a location of the hose member relative to the penis.

14. The method of claim 9, further comprising:

adjusting tension within at least one of the plurality of band members.

15. The method of claim 9, wherein the liquid is a juice.

16. The method of claim 9, wherein dispensing of the liquid through the first end occurs upon ejaculation of the penis.

17. The method of claim 9, further comprising:

decoupling the second end from the bulbous member.

18. The method of claim 9, further comprising:

refilling the bulbous member.

* * * * *